US011407603B2

(12) United States Patent
Fujino

(10) Patent No.: US 11,407,603 B2
(45) Date of Patent: Aug. 9, 2022

(54) PRINTING APPARATUS AND CONVEYANCE CONTROL METHOD

(71) Applicant: CANON KABUSHIKI KAISHA, Tokyo (JP)

(72) Inventor: Kazuhisa Fujino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/834,143

(22) Filed: Mar. 30, 2020

(65) Prior Publication Data

US 2020/0317457 A1 Oct. 8, 2020

(30) Foreign Application Priority Data

Apr. 5, 2019 (JP) ..... JP2019-073082

(51) Int. Cl.

| | |
|---|---|
| ***B65H 5/06*** | (2006.01) |
| ***B65H 7/06*** | (2006.01) |
| ***B41J 11/00*** | (2006.01) |
| ***B41J 13/00*** | (2006.01) |

(52) U.S. Cl.

CPC ..... *B65H 5/06* (2013.01); *B41J 11/006* (2013.01); *B41J 13/0018* (2013.01); *B65H 7/06* (2013.01); *B65H 2511/22* (2013.01); *B65H 2511/414* (2013.01); *B65H 2511/52* (2013.01); *B65H 2511/528* (2013.01); *B65H 2513/50* (2013.01); *B65H 2601/11* (2013.01)

(58) Field of Classification Search

CPC ..... B65H 7/06; B65H 2553/51; B65H 5/06; B65H 2511/52; B65H 2513/50

See application file for complete search history.

(56) References Cited

U.S. PATENT DOCUMENTS

| | | | | |
|---|---|---|---|---|
| 5,197,726 | A * | 3/1993 | Nogami | B65H 7/02 271/110 |
| 7,357,387 | B2 * | 4/2008 | Asada | B65H 7/18 271/10.02 |
| 7,584,951 | B2 | 9/2009 | Otani et al. | |
| 7,591,457 | B2 * | 9/2009 | Yoshida | B65H 5/06 271/10.01 |
| 10,889,134 | B2 * | 1/2021 | Ishida | B41J 11/006 |
| 2015/0344251 | A1 * | 12/2015 | Maysick | B65H 3/06 271/109 |

FOREIGN PATENT DOCUMENTS

| | | |
|---|---|---|
| JP | 4827634 B2 | 11/2011 |

* cited by examiner

*Primary Examiner* — Jeremy R Severson
(74) *Attorney, Agent, or Firm* — Venable LLP

(57) ABSTRACT

A printing apparatus includes a feeding roller, a conveyance roller, a first driving unit configured to drive the conveyance roller, a second driving unit configured to drive the feeding roller, a control unit configured to control the first and second driving units, a detection unit configured to detect an error related to the second driving unit, and a determination unit configured to determine, when the detection unit has detected the error related to the second driving unit, whether to continue the conveyance of a first print medium based on a leading edge position of a second print medium. In a case in which an error is detected by the detection unit, the control unit controls the conveyance of the first print medium by the conveyance roller based on a determination result of the determination unit.

8 Claims, 8 Drawing Sheets

START PRINTING
FEEDING
S501
S502
ERROR?
YES
NO
S503
IS THERE NEXT PAGE ?
YES
NO
S507
PRINTING AND FEEDING
S508
ERROR?
NO
YES
PRINTING
S504
S509
DETERMINE WHETHER TO CONTINUE PRINTING
S505
ERROR?
YES
NO
S510
CAN PRINTING BE CONTINUED?
NO
YES
END
PRINTING
S511
S512
YES
ERROR?
NO
S513
IS RECOVERY POSSIBLE ?
NO
YES
S514
RECOVERY PROCESSING
DISPLAY ERROR
S506

PRINTING APPARATUS AND CONVEYANCE CONTROL METHOD

BACKGROUND OF THE INVENTION

Field of the Invention

The present invention relates to a printing apparatus and a conveyance control method.

Description of the Related Art

Conventionally, in a printing apparatus, the printing speed is improved by simultaneously performing the printing operation of a preceding sheet and the sheet feeding operation of a succeeding sheet. In addition, the printing apparatus may incorporate a plurality of motors, including a conveyance motor and a sheet feeding motor, to further improve the printing speed by changing the driving amount for conveying the preceding sheet in the printing operation and the driving amount for conveying the succeeding sheet in the sheet feeding operation. As a means for individually detecting the errors of a plurality of motors, counting of a pulse signal of an encoder incorporated in a motor is proposed (for example, Japanese Patent No. 4827634). When an error of an individual motor is detected, the printing operation is stopped, and the location that requires paper jam error cancellation processing is subsequently designated, in accordance with the motor in which the error has been detected, and the user is notified of this designation.

In Japanese Patent No. 4827634, when the error of a motor is detected, all of the operations are stopped, and the user needs to discard a total of two sheets, that is, the preceding sheet undergoing a printing operation and the succeeding sheet undergoing a sheet feeding operation. More specifically, even if the conveyance motor is operating normally when an error is detected in the sheet feeding motor, the total of two sheets of the preceding sheet undergoing the printing operation and the succeeding sheet undergoing the sheet feeding operation need to be discarded because the conveyance motor will be stopped and the paper jam error cancellation processing will be prompted.

SUMMARY OF THE INVENTION

The present invention provides a technique that improves the convenience of a user when an error related to sheet conveyance occurs in a printing apparatus.

According to an aspect of the present invention, there is provided a printing apparatus comprising: a sheet feeding roller configured to feed a print medium; a conveyance roller configured to convey the print medium fed by the sheet feeding roller; a first driving unit configured to drive the conveyance roller; a second driving unit configured to drive the sheet feeding roller; a printing unit configured to print on the print medium conveyed by the conveyance roller; a control unit configured to control the first driving unit and the second driving unit so as to provide an interval between a trailing edge of a first print medium which has been fed in advance and a leading edge of a second print medium which is fed following the first medium; a detection unit configured to detect an error related to the second driving unit; a specification unit configured to specify a leading edge position of the second print medium based on a position of the first print medium; and a determination unit configured to determine, when the detection unit has detected the error related to the second driving unit, whether to continue the conveyance of the first print medium, based on the leading edge position of the second print medium, wherein in a case in which an error is detected by the detection unit, the control unit controls the conveyance of the first print medium by the conveyance roller based on a determination result of the determination unit.

Further features of the present invention will become apparent from the following description of exemplary embodiments (with reference to the attached drawings).

DESCRIPTION OF THE EMBODIMENTS

Figure 1:
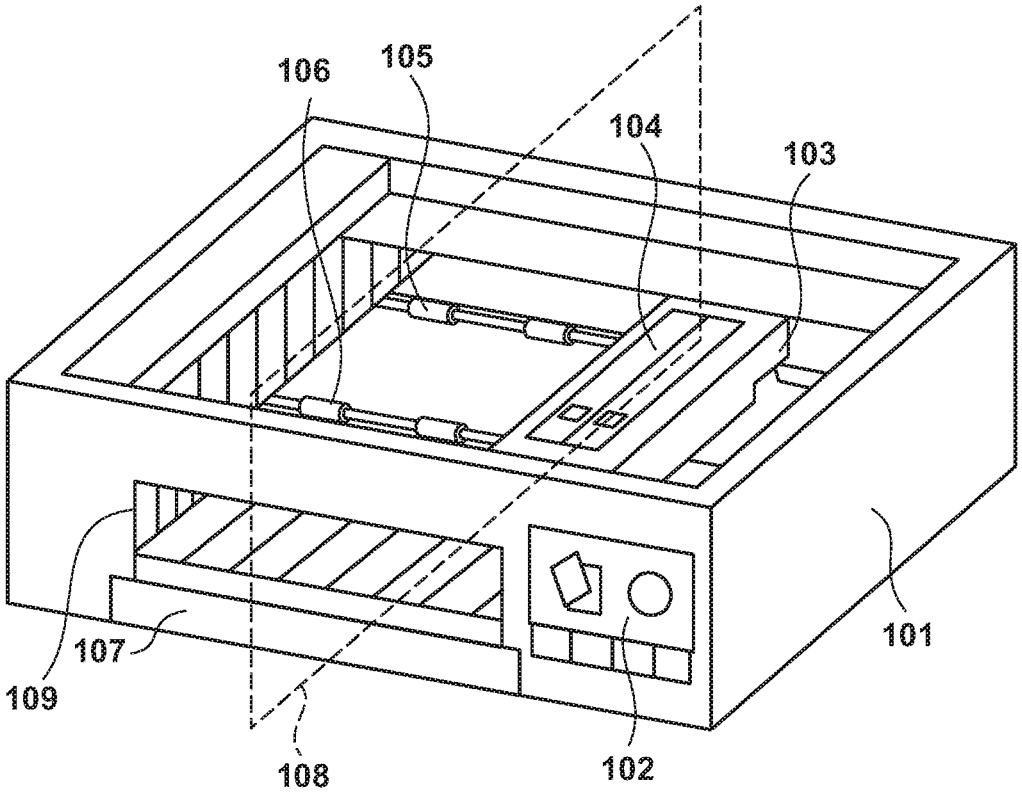
FIG. 1 is a perspective view of a printing apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Apparatus Arrangement

Figure 2:
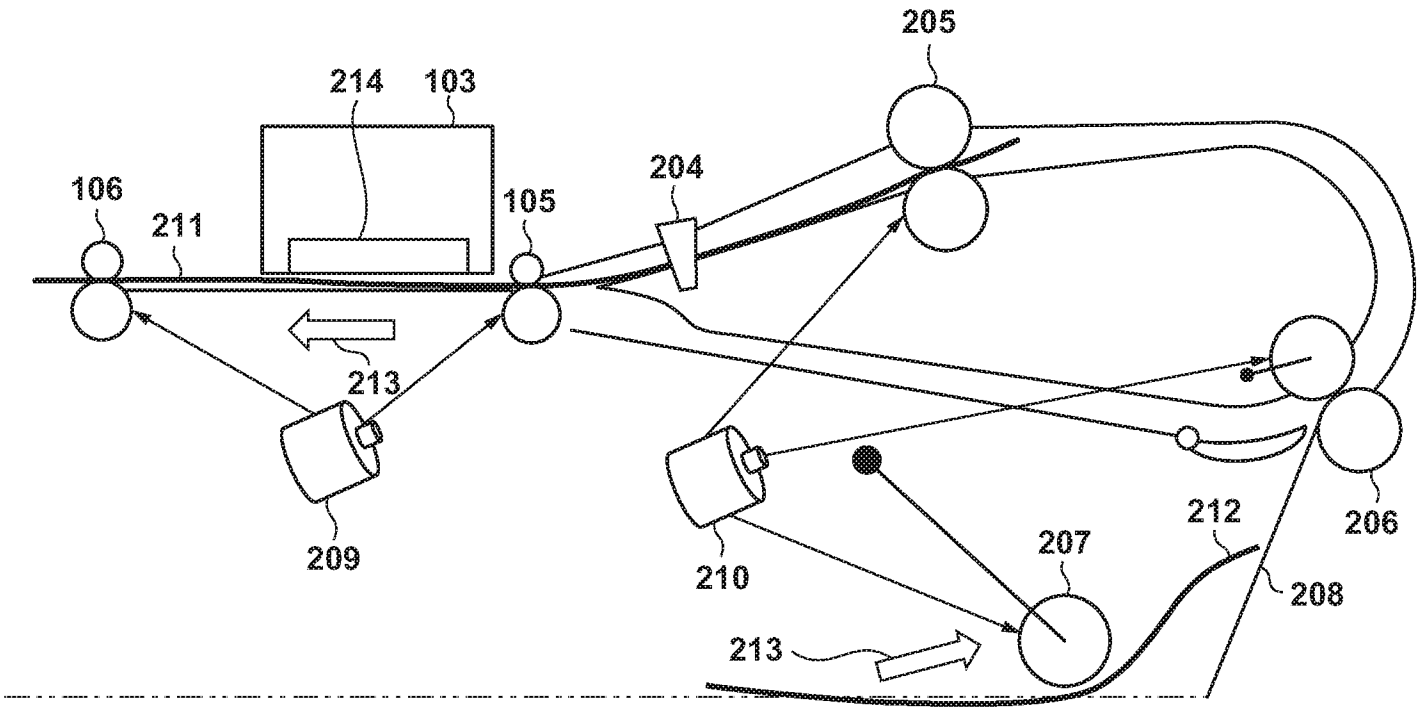
FIG. 2 is a sectional view of the printing apparatus according to the embodiment.

FIG. 1 is a schematic perspective view schematically showing an inkjet printing apparatus (to be referred to as a printing apparatus hereinafter) 101 according to this embodiment. FIG. 2 shows a section taken along broken lines 108 shown in FIG. 1, and shows a partially extracted view of the arrangement of the printing apparatus 101 according to the embodiment. The printing apparatus 101 according to the embodiment drives a sheet feeding motor 210, which serves as a driving unit, to drive a sheet feeding roller 207 to cause sheets to be fed, sheet by sheet, from a sheet feeding port 109 on which print media can be stacked. Each print medium can climb along a slope 208 of a cassette 107 to reach a pair of first middle rollers 206. Also, by driving the sheet feeding motor 210, the pair of first middle rollers 206 and a pair of second middle rollers 205 rotate in a direction to convey the print medium in a conveyance direction 213. Subsequently, by driving a conveyance motor 209 serving as a driving unit, a pair of conveyance rollers 105 and a pair of sheet discharging rollers 106 rotate to make the print medium advance in the conveyance direction 213 to convey the print medium below a printhead 214 (printing position).

The sheet feeding roller 207, the pair of first middle rollers 206, the pair of second middle rollers 205, the pair of conveyance rollers 105, and the pair of sheet discharging rollers 106 are sequentially arranged in this order from the sheet feeding port 109 as the plurality of rollers arranged in the printing apparatus 101. Hence, the pair of conveyance rollers 105 and the pair of sheet discharging rollers 106 driven by the conveyance motor 209 are arranged closer to the downstream side in the conveyance direction 213 than the sheet feeding roller 207 which is driven by the sheet feeding motor 210. In this embodiment, three pairs of rollers that can be driven by the sheet feeding motor 210 have been arranged. However, the number of the pairs of rollers to be driven may be changed in accordance with the length of a conveyance path or the length of a corresponding print medium. Furthermore, in this embodiment, although the printing apparatus 101 is described to have a dual motor arrangement including the sheet feeding motor 210 and the conveyance motor 209, it may have a mechanism which uses a single motor and switches the set of rollers to be driven.

The leading edge position of the print medium conveyed by the pair of second middle rollers 205 is detected by a sheet detection sensor 204 arranged on the conveyance path. The end of the printing medium on the downstream side in the conveyance direction will be referred to as a "leading edge" hereinafter. After the sheet detection sensor 204 has detected the leading edge position of the print medium, the leading edge position of the print medium at that point is calculated based on the driving amounts of the sheet feeding motor 210 and the conveyance motor 209. Subsequently, by discharging ink from the printhead 214 while scanning a carriage 103 mounted with the printhead 214 and an ink tank 104 in a direction perpendicular to the conveyance direction 213 of the print medium, an image is formed (to be referred to as printing hereinafter) on the print medium. By driving the sheet feeding motor 210 during the printing operation on a preceding sheet 211, a succeeding sheet 212 which is the print medium to be used in the next printing operation can be fed into the printing apparatus 101. By feeding the succeeding sheet 212 to be used in the next printing operation during the printing operation of the preceding sheet 211 which started printing in advance, the printing speeds of a plurality of sheets of print media can be improved.

A user can operate an operation unit 102 to turn on/off the power of the printing apparatus 101 and to change print settings. Also, a notification to the user can be displayed on a liquid crystal display unit of the operation unit 102 to notify the user of the state of the printing apparatus 101 and to prompt the user to make a processing operation.

Note that although this embodiment will describe an example of performing conveyance control on a conveyance path arranged in a printing apparatus, the present invention is not limited to this. For example, the control operation to be described below can be performed in a conveyance apparatus that can be connected to a printing apparatus.

Figure 3:
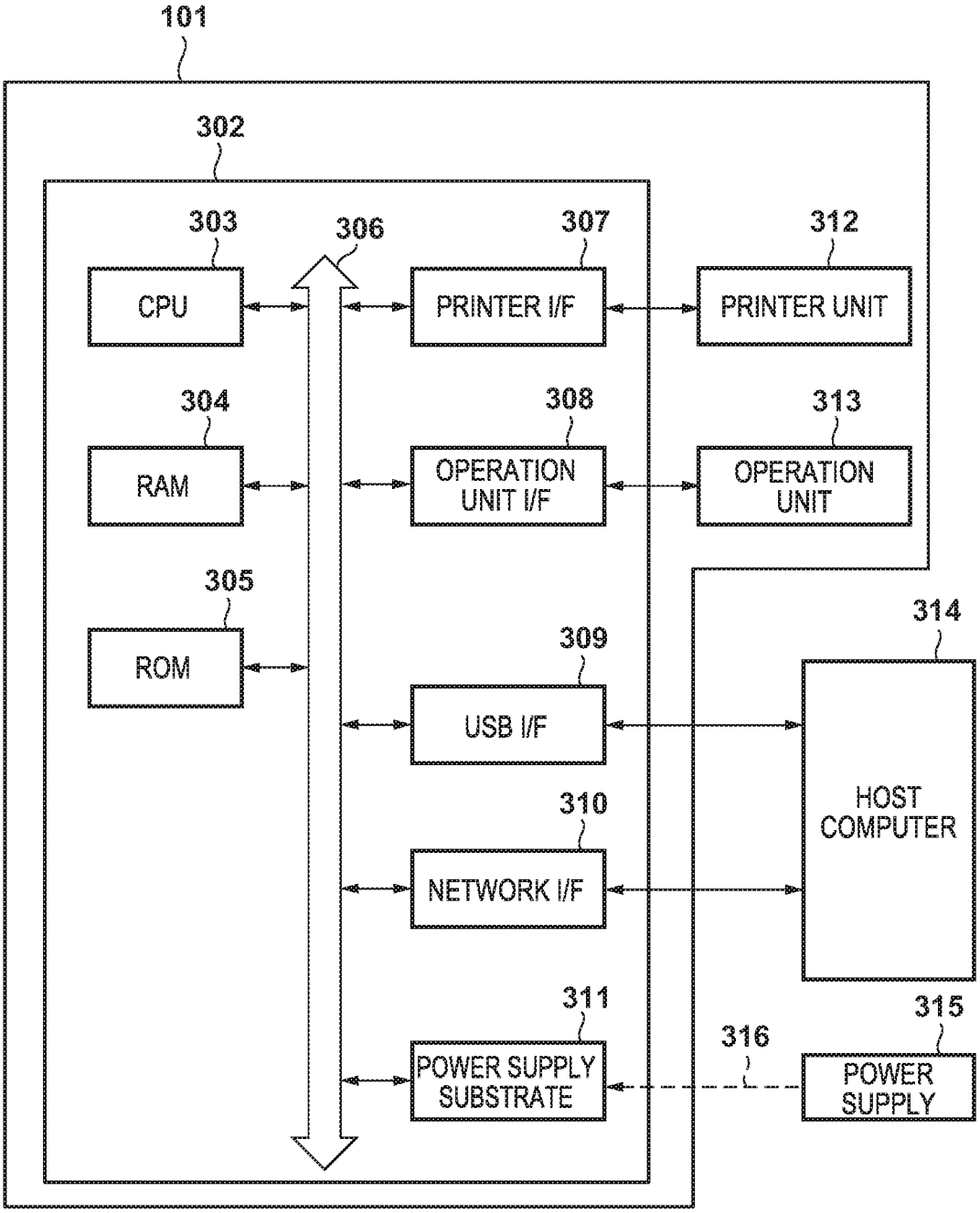
FIG. 3 is a view showing an example of the hardware arrangement of the printing apparatus according to the embodiment.

FIG. 3 shows an example of the hardware arrangement of the printing apparatus 101 according to this embodiment. The printing apparatus 101 includes a control unit 302, a printer unit 312, and an operation unit 313. A CPU (Central Processing Unit) 303 included in the control unit 302 loads various kinds of programs stored in a ROM (Read Only Memory) 305 to a RAM (Random Access Memory) 304 and performs various kinds of control, such as power-on control, print control, and the like, by reading out the corresponding program as needed. The RAM 304 is a main storage memory of the CPU 303 and is used as a work area and a temporary storage area for loading the various kinds of programs stored in the ROM 305. The ROM 305 stores image data, various kinds of programs, and various kinds of setting information. Although a flash storage or the like is assumed to be the ROM 305 in this embodiment, the ROM 305 may be formed by an auxiliary storage device such as a hard disk or the like. Note that although it is assumed in the printing apparatus 101 that the single CPU 303 will use a single memory (the RAM 304) to execute the processes shown in each flowchart to be described below, another mode may be adopted. For example, the processes shown in each flowchart to be described below can be executed by the cooperation of a plurality of CPUs, a plurality of RAMs, ROMs and storages. In addition, a hardware circuit may be used to execute some processes.

A printer I/F 307 is an interface for connecting the printer unit 312 and the control unit 302. Image data to be printed by the printer unit 312 is transferred from the control unit 302 via the printer I/F 307 and is printed on a print medium such as a sheet by the printer unit 312. An operation unit I/F 308 is an interface for connecting the operation unit 313 and the control unit 302. The operation unit 313 includes an operation key and a liquid crystal display unit which has a touch panel function, and functions as an accepting unit that accepts instructions from the user.

A USB I/F 309 and a network I/F 310 are interfaces for controlling communication with a host computer 314 which is connected to the printing apparatus 101. Note that the communication method and the connection method are not particularly limited, and it is possible to employ various kinds of methods. A power supply substrate 311 transforms the power supply voltage supplied from a power supply 315 via a power supply cable 316 and supplies the transformed power supply voltage to the printing apparatus 101. The power supply substrate 311 may also include a storage battery that can store the power. The host computer 314 is an information processing apparatus such as a PC (personal computer), a portable terminal, or the like, and provides image data and the like used for printing to the printing apparatus 101.

Figure 4:
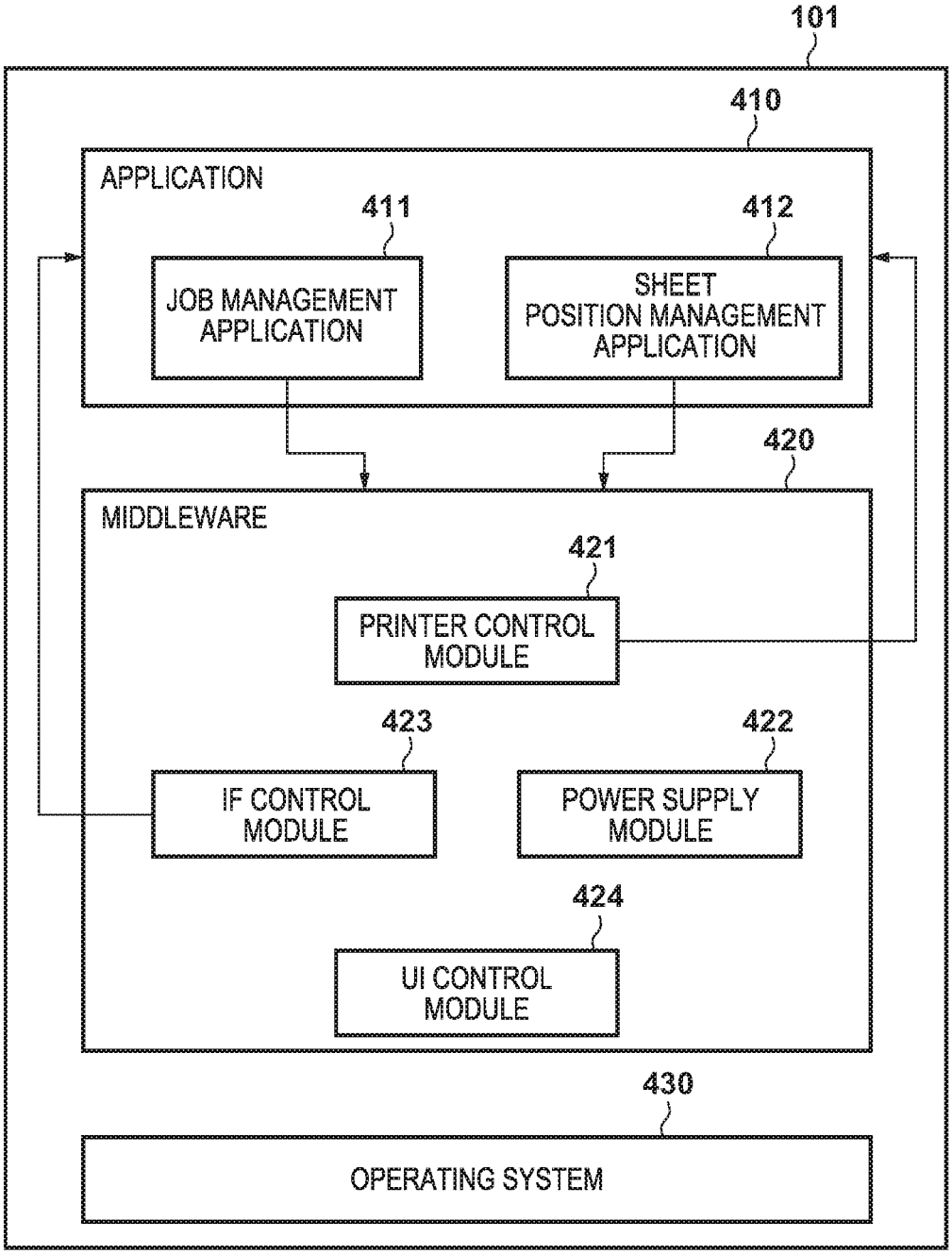
FIG. 4 is a view showing an example of the software arrangement of the printing apparatus according to the embodiment.

FIG. 4 shows an example of the software arrangement of a control program for controlling each hardware module loaded to the RAM 304 according to this embodiment. The control program can be largely divided into three blocks: an application 410 that manages applications, middleware 420 for controlling the apparatus via various kinds of I/Fs, and an operating system 430 that manages the control of the overall apparatus. The operating system 430 provides the basic function for executing the control program by the control unit 302. The middleware 420 if formed by pieces of software that control the I/Fs with the printer unit 312 and the physical devices. In this embodiment, a printer control module 421 is present as a module that controls the printer I/F 307. In a similar manner, the middleware 420 includes an IF control module 423, which controls the USB I/F 309 and the network I/F 310 as devices used for communication with the host computer 314, and a UI control module 424, which controls the operation unit I/F 308, and the like.

The application 410 is formed by applications for operating devices via the middleware 420 to implement functions such as printing and the like that the printing apparatus 101 is to provide to the user. For example, when the UI control module 424 detects that the user has instructed a printing operation via the operation unit 313 and the operation unit I/F 308, the application 410 is notified of this instruction. Upon receiving the notification, the application 410 executes the job management application 411 for printing. The job management application 411 uses the printer control module 421 of the middleware 420 to execute the printing operation by the printer unit 312.

A sheet position management application 412 uses the printer control module 421 of the middleware 420 to control the printer unit 312 to manage the position of the print medium in the printing apparatus 101. More specifically, the leading edge position of the print medium is calculated from the timing at which the sheet detection sensor 204 detected the print medium and the driving amounts of the sheet feeding motor 210 and the conveyance motor 209. By calculating the leading edge position of the print medium, it is possible to calculate the trailing edge position of the print medium based on the sheet length of the print medium, and to predict the leading edge position of the succeeding sheet, which is the next print medium, from the driving amount of the sheet feeding motor 210.

This embodiment will describe an example in which two sheets of print media, that is, a preceding sheet which is to be printed first and a succeeding sheet which is to be printed next, are conveyed as the print media to be conveyed in the printing apparatus 101. However, the present invention is not limited to this. For example, the embodiment is applicable to the conveyance of a larger number of sheets of print media in accordance with the arrangement (the length of the conveyance path and the like) of the printing apparatus, the type of print medium that can be supported, and the like.

Processing Procedure

The printing operation by the printing apparatus 101 according to this embodiment will be described with reference to FIG. 5. The printing apparatus 101 controls the USB I/F 309 or the network I/F 310 by the IF control module 423 to receive a print job from the host computer 314. The IF control module 423 notifies the job management application 411 of the print job. The job management application 411 transmits a start notification to the printer control module 421. The processing procedure is started as a result.

In step S501, the printer control module 421 controls the printer unit 312 via the printer I/F 307 to drive the sheet feeding motor 210. Feeding of the print medium is performed by driving the sheet feeding motor 210 to make the sheet feeding roller 207, the pair of first middle rollers 206, and the pair of second middle rollers 205 rotate so that the print medium will be conveyed along the conveyance direction 213.

In step S502, the printer control module 421 determines whether an error has occurred in the sheet feeding process performed in step S501 based on the state of the load of the sheet feeding motor 210. If it is determined that an error has occurred (YES in step S502), the process advances to step S506. Otherwise (NO in step S502), the process advances to step S503. For example, it will be determined that an error has occurred in a case in which the load of the sheet feeding motor 210 has increased to a threshold or more. In this case, the printer control module 421 will notify the job management application 411 of this determination. The printer control module 421 can detect, based on this notification, that an error has occurred. If an error has occurred, the job management application 411 will notify the UI control module 424 to inform the user that an error has occurred in the job that is being executed. An error in this case can be a paper jam error that has occurred in a roller driven by the sheet feeding motor 210. As another error, for example, a case in which it is impossible to detect the load that should be applied during a sheet feeding operation because the load on the sheet feeding motor 210 does not change in the sheet feeding operation can be handled as an error in which the print medium (sheet) is absent (an out of paper error).

Figure 7A:
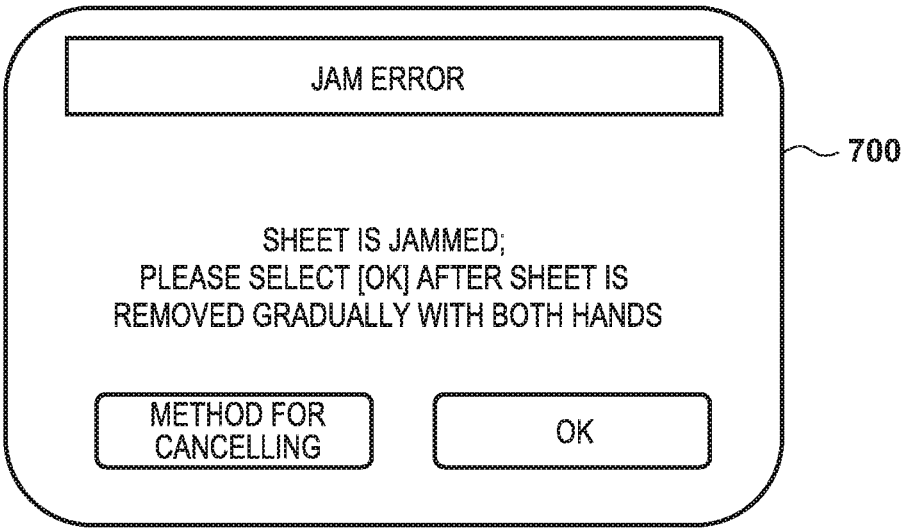
FIGS. 7A and 7B are views showing an example of an error notification according to the embodiment.
Figure 7B:
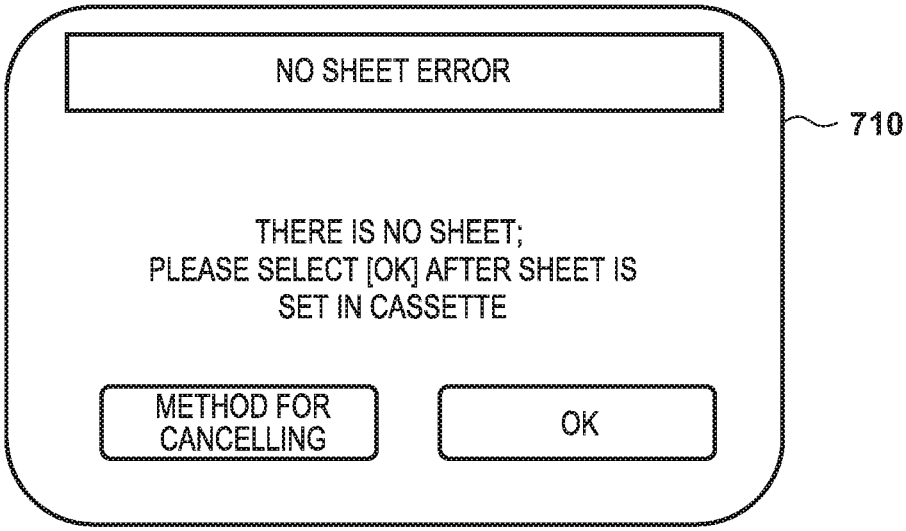

In step S506, the UI control module 424 controls the operation unit 102 via the operation unit I/F 308 and displays an error screen on the operation unit 313. FIG. 7A shows an example of an error screen 700 which is displayed when a paper jam error has occurred. Also, FIG. 7B shows an example of an error screen 710 which is displayed when a print medium cannot be detected in the sheet feeding operation. After this process, the print job ends, and the processing procedure ends.

Note that although error display is immediately performed when an error occurs at the time of the feeding of the first sheet in this embodiment, the sheet feeding operation may be retried by calculating the leading edge position of the print medium from the driving amount of the sheet feeding motor 210 to perform a recovery possibility determination shown in step S513 (to be described later) and performing recovery processing in step S514.

After the print medium has reached the sheet detection sensor 204 without the occurrence of an error and the sheet feeding operation has been completed, the job management application 411 confirms, in step S503, whether the print job includes information of a next page which is to succeed the current page to be printed on the fed print medium. As a confirmation method, the job management application 411 may receive a page count from the host computer 314 at the start of the job, and confirm whether a next page is present from a difference between the received page count and the current print count. Alternatively, information may be received each time from the host computer 314 through the IF control module 423 via the USB I/F 309. As a result of the confirmation, if it is determined that the next page is not present (NO in step S503), the process advances to step S504. Otherwise (YES in step S503), the process advances to step S507.

In step S504, the job management application 411 instructs the printer control module 421 to perform printing of the page on the print medium that has been fed. The printer control module 421 controls the printer unit 312 via the printer I/F 307 and performs printing on the fed print medium.

In step S505, the printer control module 421 determines whether an error has occurred in the printing operation. If it is determined that an error has occurred (YES in step S505), the process advances to step S506. For example, it will be determined that an error has occurred in a case in which the load on the conveyance motor 209 or the sheet feeding motor 210 has increased to a threshold or more. In this case, the printer control module 421 will notify the job management application 411 of this determination. The printer control module 421 can detect that an error has occurred based on this notification. If it is determined that an error has occurred, the job management application 411 notifies the UI control module 424 of the error. Subsequently, the process advances to step S506, and an error screen as described above is displayed. On the other hand, if it is determined that an error has not occurred (NO in step S505), the print job is ended normally, and the processing procedure ends.

In step S507, the job management application 411 instructs the printer control module 421 to perform printing on the print medium which has been fed and to feed a print medium for the next page. The printer control module 421 controls the printer unit 312 via the printer I/F 307 and drives the conveyance motor 209 and the sheet feeding motor 210 to perform the sheet feeding operation of the next print medium in parallel to the printing operation on the current print medium. As described above, the page interval between the print medium undergoing printing of the current page and the print medium of the next page can be shortened by performing the printing operation and the sheet feeding operation in parallel. As a result, the printing time can be shortened on a job basis in a case in which printing of a plurality of pages has been set.

In step S508, the job management application 411 determines whether an error has occurred in the printing operation and the sheet feeding operation. If it is determined that an error has not occurred (NO in step S508), the process returns to step S503. Printing of a plurality of sheets is implemented by returning to step S503 and repeating the process to further perform printing or printing and sheet feeding of a next page. If it is determined that an error has occurred (YES in step S508), the process advances to step S509.

In step S509, the job management application 411 performs processing to determine whether printing is to be continued. The detailed processing of this step will be described later with reference to FIG. 6.

In step S510, the job management application 411 determines whether printing can be continued based on the processing result of step S509. If it is determined that the printing cannot be continued (NO in step S510), the process advances to step S506. In this case, the job management application 411 notifies the UI control module 424 of the fact that the printing cannot be continued. If it is determined that the printing can be continued (YES in step S510), the process advances to step S511.

In step S511, the printer control module 421 makes the print processing continue by stopping the sheet feeding motor 210 and making only the conveyance motor 209 operate to convey the print medium by the pair of conveyance rollers 105 and the pair of sheet discharging rollers 106.

In step S512, the job management application 411 determines whether an error has occurred during the print processing of step S511. If it is confirmed that an error has occurred (YES in step S512), the process advances to step S506. In this case, the job management application 411 notifies the UI control module 424 of the occurrence of the error. If the error has not occurred (NO in step S512), the process advances to step S513.

In step S513, the job management application 411 determines, based on the processing result of step S509, whether a recovery is possible. If it is determined that a recovery is impossible (NO in step S513), the process advances to step S506. Otherwise (YES in step S513), the process advances to step S514.

In step S514, the job management application 411 performs recovery processing corresponding to the contents of the error. More specifically, as the recovery processing, for example, in a case in which an error has occurred due to an increase in the temperature of the sheet feeding motor 210, the operation may be stopped until the motor cools down. The recovery processing may also be performed by rotating the sheet feeding motor 210 in reverse of the conveyance direction or by temporarily disconnecting the driving system that transmits power of the sheet feeding motor 210 to the various kinds of rollers and reconnecting the driving system again. In addition, the recovery processing may be arranged by combining a plurality of types of recovery operations or be arranged to repeat the same operation a predetermined number of times. Subsequently, the process returns to step S501, and the processing is repeated.

Figure 8A:
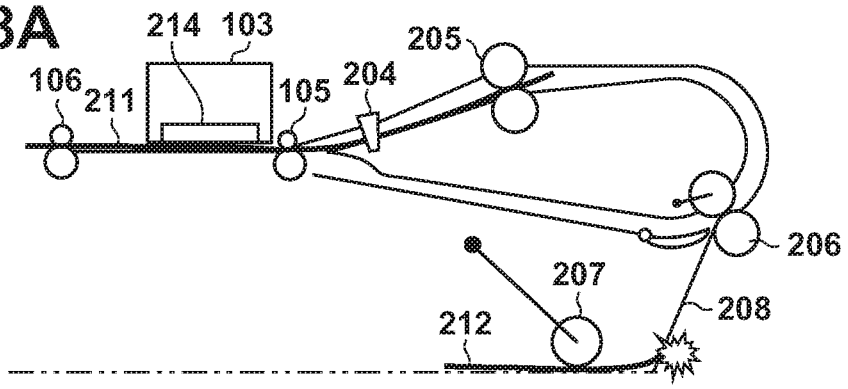
FIGS. 8A to 8D are views for explaining a positional relationship of a sheet according to the embodiment.

For example, as shown in FIG. 8A, consider a case in which an error occurs in the sheet feeding motor 210 due to a load increase in the sheet conveyance operation caused by the succeeding sheet 212 striking against the slope 208 in the cassette 107. In this case, a reduction in the tension increased due to the strike can be expected by performing the recovery processing by rotating the sheet feeding motor 210 in the reverse direction. In this manner, since the process will move to the sheet feeding operation of the next page automatically after the recovery processing, the user can obtain a printed product without realizing that there was a problem with the sheet feeding motor 210. Note that the recovery processing of the sheet feeding motor 210 is not limited to the reverse rotation of the motor, but suffices to be a processing operation that can reduce the tension increased by the strike. For example, the recovery processing may be processing to turn off (for example, processing to release the holding force) the sheet feeding motor 210.

Note that it may be arranged so the recovery operation will be retried a predetermined number of times in a case in which the error is not solved when the recovery processing has been performed after the completion of the printing operation. In this case, it may be arranged so the number of retries will be counted and a maintenance notification will be transmitted to the user via the operation unit 313 when the error is not solved even after the number of retries has exceeded a threshold. Furthermore, it may be arranged so a message prompting the repair of the apparatus will be displayed on the operation unit 313 in a case in which the error is not solved even after the user has performed a maintenance operation.

Printing Continuation Determination Processing

The printing continuation determination processing according to this embodiment will be described with reference to FIG. 6. This processing corresponds to the process of step S509 of FIG. 5.

In step S601, the job management application 411 determines whether the error detected in step S508 is an error of the conveyance motor 209. For example, a state such as FIG. 8C can be assumed as the error of the conveyance motor 209. That is, a case in which a conveyance error (for example, a paper jam error) has occurred on the rollers (the pair of sheet discharging rollers 106 in the example shown in FIG. 8C) driven by the conveyance motor 209 can be raised. If it is determined that the detected error is an error of the conveyance motor 209 (YES in step S601), the process advances to step S602. If it is determined not to be an error of the conveyance motor 209 (NO in step S601), the process advances to step S603.

Figure 8B:
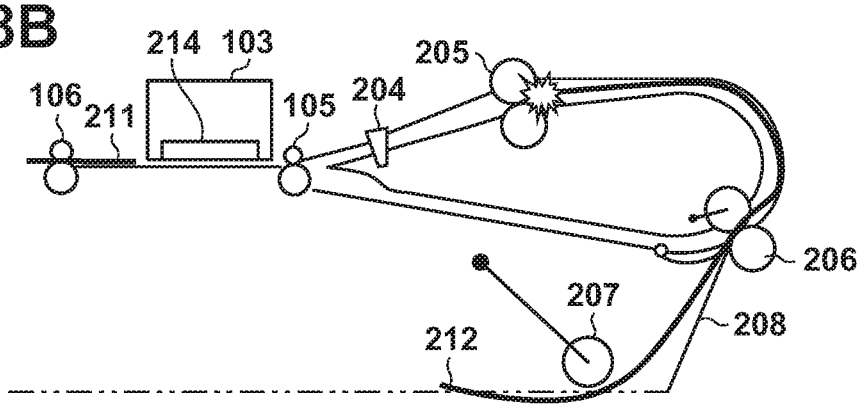
Figure 8C:
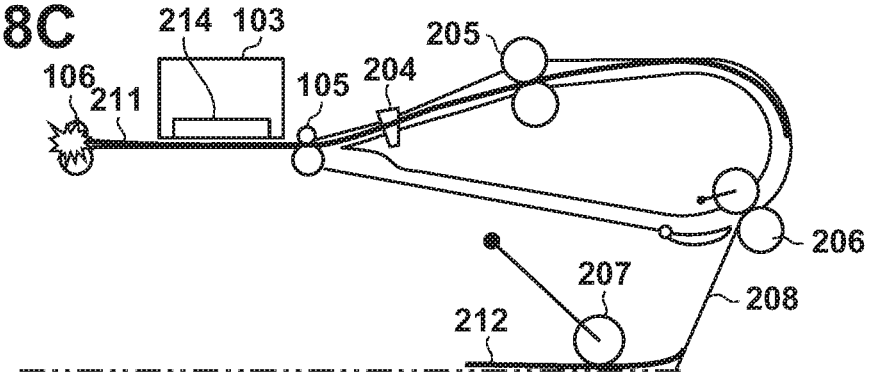

In step S602, since the preceding sheet 211 which is the current print medium being printed cannot be conveyed in a state as shown in FIG. 8C, the job management application 411 determines that the printing operation cannot be continued. Furthermore, the job management application 411 will also determine that a recovery is impossible. Subsequently, the processing procedure ends. Note that although the determination is performed on only the conveyance motor 209 in this case, if a discharge motor that individually moves the pair of sheet discharging rollers 106 is present, the determination can be performed on this motor.

In step S603, the sheet position management application 412 calculates the sheet leading edge position of the preceding sheet 211 and the sheet leading edge position of the succeeding sheet 212. More specifically, the sheet position management application 412 obtains, via the printer control module 421, the driving amounts of the sheet feeding motor 210 and the conveyance motor 209 after the leading edge of the preceding sheet 211 by the sheet detection sensor 204 has been detected. Then, the sheet position management application 412 calculates the leading edge position at that point based on the driving amount from the detected leading edge of the preceding sheet 211. In addition, the sheet position management application 412 calculates the trailing edge position of the preceding sheet 211 based on the leading edge position and the sheet length of the preceding sheet 211. Furthermore, the sheet position management application 412 calculates, from the trailing edge position of the preceding sheet 211, the driving amount since the sheet has passed the sheet feeding roller 207, and derives the leading edge position of the succeeding sheet 212 based on the sheet feeding interval at the time when the sheet feeding roller 207 performs continuous feeding. In general, at the sheet feeding roller 207, the next print medium is fed in the conveyance direction after a fixed amount of dead zone has passed since the preceding sheet 211 has passed through. Hence, the leading edge of the succeeding sheet 212 can be calculated based on this fixed amount. Also, the derivation method of the leading edge position can be changed in accordance with the position of the sheet detection sensor 204, the amount of the dead zone of the sheet feeding roller 207, the number of sensor motors, and the like.

Figure 8D:
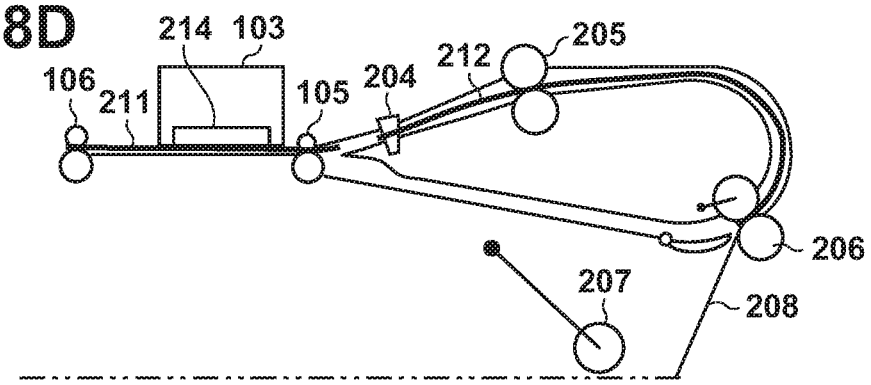

In step S604, the job management application 411 determines, based on the leading edge position of the preceding sheet 211 and the leading edge position of the succeeding sheet 212, whether the printing operation can be continued. A case in which the error is not the error of the conveyance motor 209 but the printing operation cannot be continued is, for example, a case in which the state of the succeeding sheet 212 is outside the state assumed by the design and the continuation of the printing operation may damage the apparatus body or the print medium. More specifically, it is possible to consider a case (FIG. 8D) in which the preceding sheet 211 and the succeeding sheet 212 are conveyed in an overlapping state because the sheet detection sensor 204 has detected the leading edge of the succeeding sheet 212 at an earlier timing than expected. If it is determined that the printing cannot be continued (NO in step S604), the process advances to step S602. This is because the printing operation on the succeeding sheet 212 cannot be performed even if the sheet feeding operation is returned in a case in which the preceding sheet 211 is not discharged by the printing operation. On the other hand, if the printing can be continued (YES in step S604), the process advances to step S605.

In step S605, the job management application 411 determines that the printing can be continued. The determination result here is held in, for example, the RAM 304 or the like.

In step S606, the job management application 411 determines, based on the leading edge position of the succeeding sheet 212, whether a recovery from the error state is possible. More specifically, a case in which the load may have increased due to the way the print medium struck the slope 208 and the load may be reduced by making the sheet feeding roller 207 rotate in reverse once can be raised. Although, primarily, the print medium is to be conveyed along the slope 208 and is to reach the pair of the first middle rollers 206, an error will occur more easily in an arrangement, such as FIG. 8A, in which the slope 208 has become steeper due to the increase in the size of the cassette 107. Note that this processing for determining whether a recovery from the error state is possible determines whether the normal state can be recovered by only the control of the printing apparatus 101. In other words, an error will be determined if it is estimated to be a case in which the print medium needs to be discharged manually. Since the recovery from the error state will not be performed in a case in which the leading edge of the succeeding sheet 212 has reached the pair of first middle rollers 206 in this embodiment, the error determination will be made based on the position at which the leading edge of the succeeding sheet 212 is present.

Furthermore, an error state can also occur in a case in which the load has increased due to the increase in the temperature of the sheet feeding motor 210. In this case, the sheet feeding operation can be performed successfully by decreasing the load by stopping the driving of the motor and letting the motor cool down. On the other hand, a paper jam error may have occurred in a case in which the load of the sheet feeding motor 210 has increased in a state in which the succeeding sheet 212 has been conveyed in the manner shown in FIG. 8B. Performing a sheet feeding operation again when the paper jam error has occurred may damage the main body of the printing apparatus 101. In this manner, if it is determined that a recovery from the error state is possible (YES in step S606), the process advances to step S608. Otherwise (NO in step S606), the process advances to step S607.

In step S607, the job management application 411 determines that a recovery is impossible. This determination result is held in, for example, the RAM 304 or the like. Subsequently, the processing procedure ends.

In step S608, the job management application 411 determines that a recovery is possible. This determination result is held in, for example, the RAM 304 or the like. Subsequently, the processing procedure ends.

Figure 5:
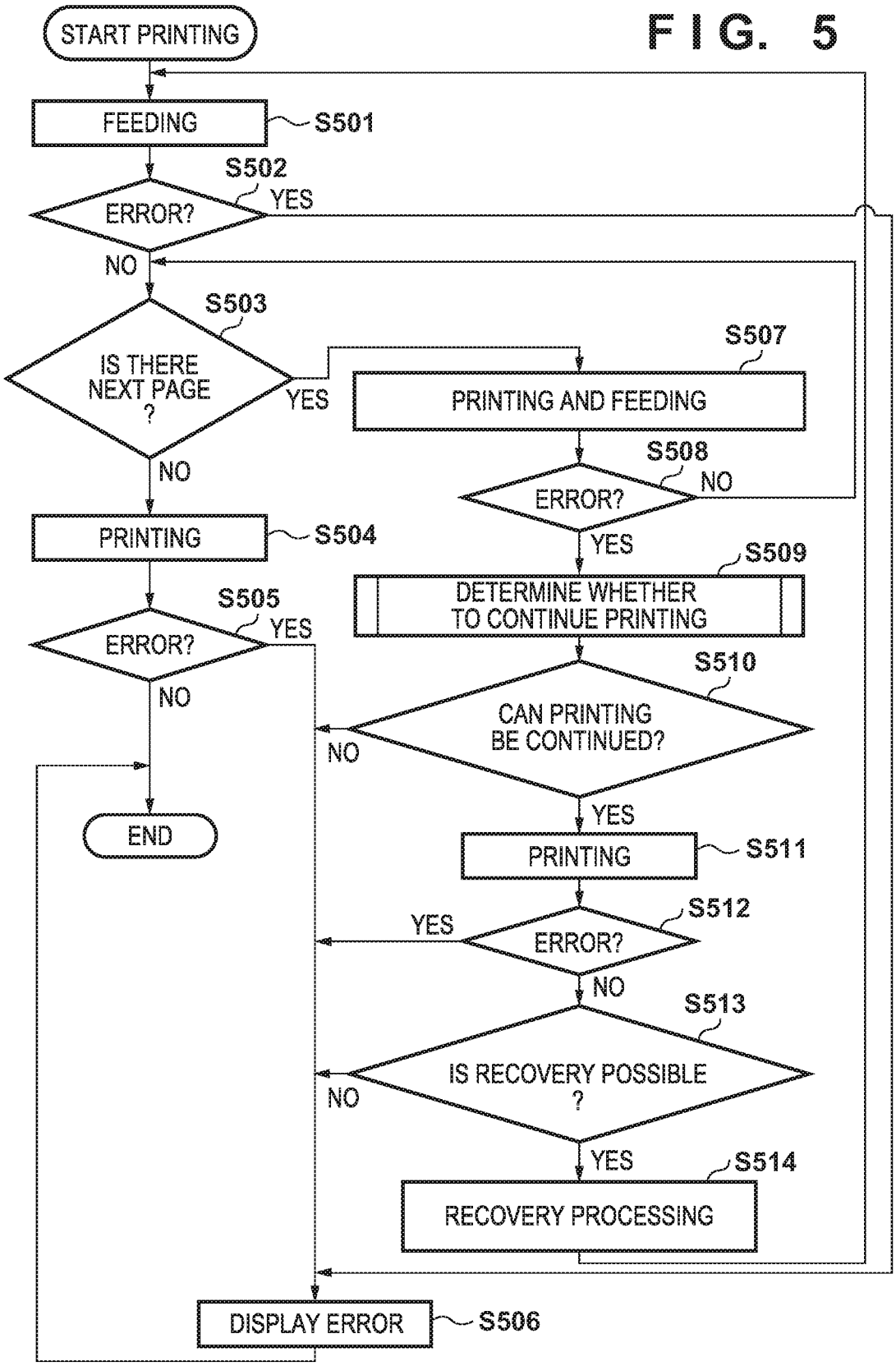
FIG. 5 is a flowchart of control processing according to the embodiment.
Figure 6:
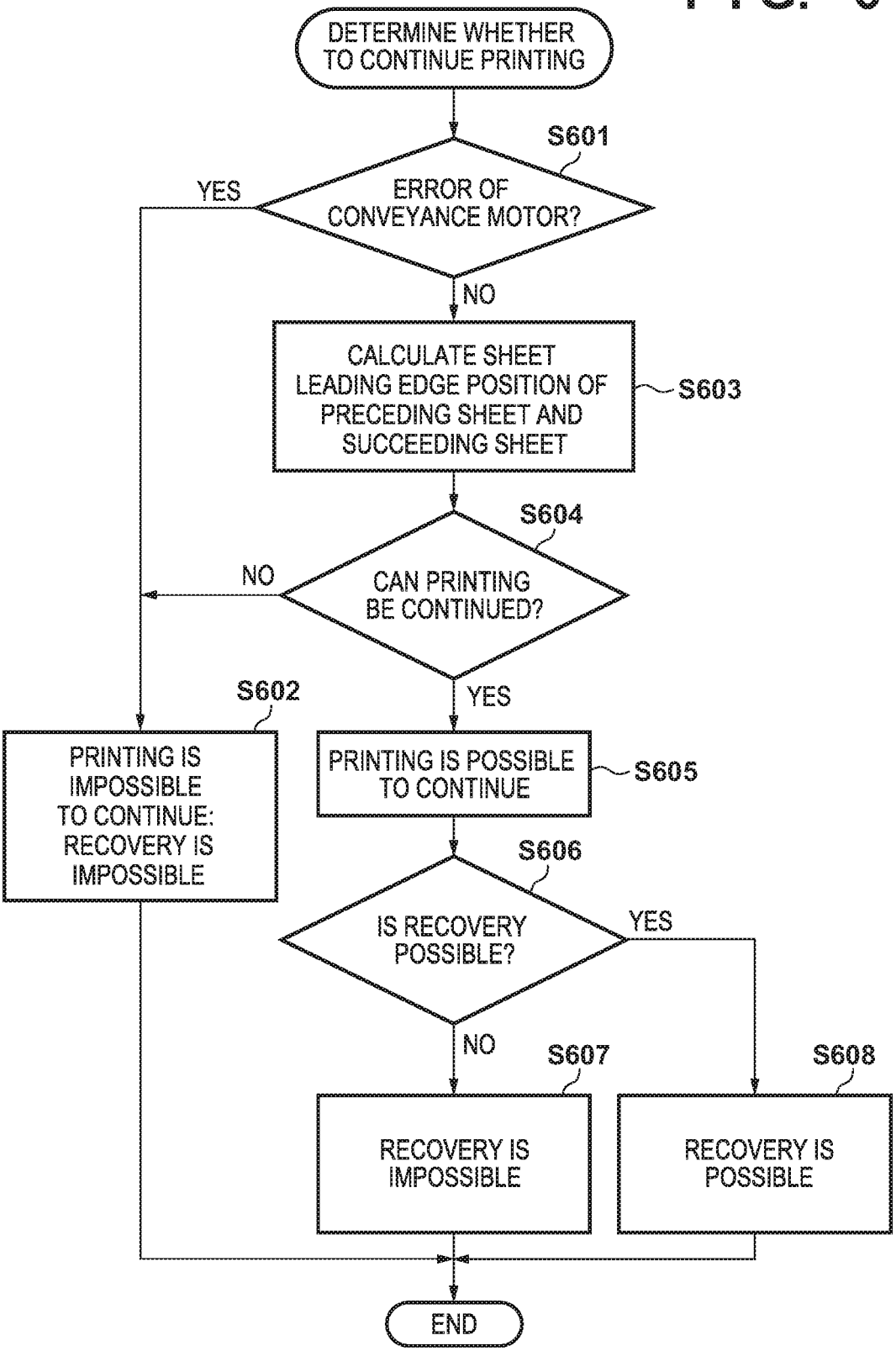
FIG. 6 is a flowchart of the control processing according to the embodiment.

In the processes of step S510 and subsequent steps of FIG. 5, conveyance control will be performed based on the determination result of FIG. 6 described above.

As described above, according to this embodiment, even if an error occurs with a succeeding sheet, the printing operation of a preceding sheet can be completed to avoid disadvantaging the user. In addition, since the preceding sheet will be absent when the recovery processing is to be performed to retry the feeding of the succeeding sheet, the driving of the conveyance motor 209 need not be restricted. By distinction of the error by its type and allowing the printing operation to continue in this manner, it is possible to automatically recover from a paper jam state and be advantageous for the user.

As described above, according to this embodiment, disadvantaging of the user can be avoided at the time of the printing operation even when an error has occurred. In addition, since performing a determination by predicting the leading edge position of the succeeding sheet from the leading edge position of the preceding sheet requires only one sensor for detecting the print medium, size and the cost of the printing apparatus can be effectively reduced.

Furthermore, the effect of continuing the printing operation of the preceding sheet increases particularly in the case of a single motor arrangement which is different from the arrangement of this embodiment and includes only the conveyance motor. Since printing and discharging the preceding sheet before the recovery processing will allow the recovery processing to be performed without consideration of the position of the preceding sheet, the processing can be simplified, and it is possible to suppress the influence on the accuracy of printing on the preceding sheet.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-073082, filed Apr. 5, 2019, which is hereby incorporated by reference herein in its entirety.

What is claimed is:

1. A printing apparatus comprising:

a sheet feeding roller configured to feed a print medium;

a conveyance roller configured to convey the print medium fed by the sheet feeding roller;

a first driving unit configured to drive the conveyance roller;

a second driving unit configured to drive the sheet feeding roller;

a printing unit configured to print on the print medium conveyed by the conveyance roller;

a control unit configured to control the first driving unit and the second driving unit so as to convey a first print medium which has been fed in advance and a second print medium which is fed following the first print medium; and a detection unit configured to detect a first error related to the first driving unit and a second error related to the second driving unit, wherein in a case in which the first error is detected by the detection unit, the conveyance of the first print medium and the second print medium is stopped, and wherein in a case in which the second error is detected by the detection unit, the control unit causes the first driving unit to drive the conveyance roller to continue the conveyance of the first print medium, and causes the second driving unit to stop driving of the sheet feeding roller to stop the conveyance of the second print medium.

2. The printing apparatus according to claim 1, further comprising:

a determination unit configured to determine, when the detection unit has detected the second error related to the second driving unit, whether to continue the conveyance of the first print medium based on a leading edge position of the second print medium.

3. The printing apparatus according to claim 2, wherein in a case in which the second error is detected by the detection unit, the determination unit further determines, in accordance with a position of the second print medium, whether it is possible to recover from the state of the second error, and the control unit causes a recovery operation to be performed by using the first driving unit and the second driving unit based on the determination result of the determination unit.

4. The printing apparatus according to claim 3, further comprising:

a notification unit configured to notify a user of an error in a case in which the print medium cannot be conveyed after repeating the recovery operation a predetermined number of times.

5. A printing apparatus comprising:

a sheet feeding roller configured to feed a print medium;

a conveyance roller configured to convey the print medium fed by the sheet feeding roller;

a first driving unit configured to drive the conveyance roller;

a second driving unit configured to drive the sheet feeding roller;

a printing unit configured to print on the print medium conveyed by the conveyance roller;

a control unit configured to control the first driving unit and the second driving unit so as to convey a first print medium which has been fed in advance and a second print medium which is fed following the first print medium;

a detection unit configured to detect a first error related to the first driving unit and a second error related to the second driving unit and a determination unit configured to determine whether it is possible to recover from the state of the second error in accordance with a position of the second print medium when the second error is detected by the detection unit, wherein in a case in which the second error is detected by the detection unit, the control unit causes the first driving unit to drive the conveyance roller to continue the conveyance of the first print medium, and causes the second driving unit to stop driving of the sheet feeding roller to stop the conveyance of the second print medium, and wherein in a case in which it is determined by the determination unit that a recovery operation is possible, the control unit causes the recovery operation to be performed after the conveyance of the first print medium has been completed.

6. A printing apparatus comprising:

a sheet feeding roller configured to feed a print medium;

a conveyance roller configured to convey the print medium fed by the sheet feeding roller;

a first driving unit configured to drive the conveyance roller;

a second driving unit configured to drive the sheet feeding roller;

a printing unit configured to print on the print medium conveyed by the conveyance roller;

a control unit configured to control the first driving unit and the second driving unit so as to convey a first print medium which has been fed in advance and a second print medium which is fed following the first print medium;

a first detection unit configured to detect a first error related to the first driving unit and a second error related to the second driving unit;

a second detection unit configured to detect, on a conveyance path, a leading edge position of the first print medium; and a specification unit configured to specify a leading edge position of the second printing medium based on a position of the first print medium, wherein the specification unit derives the leading edge position of the second print medium based on the leading edge position of the first print medium detected by the second detection unit and a driving amount of the first driving unit and a driving amount of the second driving unit, and wherein in a case in which the second error is detected by the second detection unit and it is determined, based on the leading edge position of the second print medium, that the conveyance of the first print medium can be continued, the control unit causes the first driving unit to drive the conveyance roller to continue the conveyance of the first print medium, and causes the second driving unit to stop driving of the sheet feeding roller to stop the conveyance of the second print medium.

7. The printing apparatus according to claim 6, wherein the specification unit derives the leading edge position of the second print medium based on an interval at which the sheet feeding roller feeds sheets during continuous feeding.

8. The printing apparatus according to claim 6, wherein the specification unit derives the leading edge position of the second print medium based on a trailing edge position of the first print medium based on the leading edge position of the first print medium and a sheet length of the first print medium.

* * * * *